US012305854B2

(12) United States Patent
Wester

(10) Patent No.: US 12,305,854 B2
(45) Date of Patent: May 20, 2025

(54) CHIMNEY FLUE HEATER

(71) Applicant: KC Wester LLC, Santa Fe, NM (US)

(72) Inventor: Kenneth C. Wester, Santa Fe, NM (US)

(73) Assignee: KC Wester LLC, Santa Fe, NM (US)

( * ) Notice: Subject to any disclaimer, the term of this patent is extended or adjusted under 35 U.S.C. 154(b) by 655 days.

(21) Appl. No.: 17/730,008

(22) Filed: Apr. 26, 2022

(65) Prior Publication Data

US 2022/0349576 A1 Nov. 3, 2022

Related U.S. Application Data

(60) Provisional application No. 63/183,525, filed on May 3, 2021.

(51) Int. Cl.
*F23L 17/16* (2006.01)
*F23J 13/04* (2006.01)

(52) U.S. Cl.
CPC ..... *F23L 17/16* (2013.01); *F23J 13/04* (2013.01)

(58) Field of Classification Search
CPC ..... F23L 17/16; F23J 2900/13002
See application file for complete search history.

(56) References Cited

U.S. PATENT DOCUMENTS

| | | | | |
|---|---|---|---|---|
| 901,871 | A | 10/1908 | Blanchard | |
| 1,389,252 | A | 8/1921 | Lucas | |
| 1,401,500 | A | 12/1921 | Scott | |
| 1,827,788 | A | 11/1926 | Hicks | |
| 1,759,830 | A | 5/1930 | Blanchard | |
| 2,737,132 | A | 3/1956 | Ames | |
| 4,002,465 | A | 1/1977 | Brusa | |
| 4,158,439 | A * | 6/1979 | Gibbs | F28D 21/0007 237/55 |
| 4,179,065 | A | 12/1979 | Zung | |
| 4,291,545 | A | 9/1981 | Worsham, III | |

(Continued)

FOREIGN PATENT DOCUMENTS

| | | |
|---|---|---|
| AT | 393 159 B | 8/1991 |
| CA | 2018142 C | 6/1999 |

(Continued)

OTHER PUBLICATIONS

*Draw Collar*, Atmosfire, Afton, WY, date unknown, accessed Apr. 26, 2022 from https://theatmosfire.com/product/draw-collar/.

(Continued)

*Primary Examiner* — David J Laux
(74) *Attorney, Agent, or Firm* — Santa Fe IP, LLC

(57) ABSTRACT

A chimney flue heater for selectively inducing an updraft within a chimney flue generally includes a body releasably hanging from a flue liner and a heating assembly to heat air and induce an updraft within the chimney flue. The body includes a hanger assembly having (i) a top member extending outwardly from an upper portion of the planar support and (ii) a side member extending downwardly from the top member and overlapping an outer surface of the flue liner. The planar support extends downwardly from the hanger assembly and along an inner surface of the flue liner. The heating assembly is mounted on the planar support opposite the hanger assembly. A method of using the chimney flue heater is also disclosed.

17 Claims, 6 Drawing Sheets

(56) References Cited

U.S. PATENT DOCUMENTS

| | | | | |
|---|---|---|---|---|
| 4,374,506 | A | 2/1983 | Whalen | |
| 4,429,661 | A | 2/1984 | McClure | |
| 4,532,915 | A * | 8/1985 | de Rham | F23J 13/08 52/19 |
| 4,646,713 | A | 3/1987 | Honigsbaum | |
| 4,649,808 | A | 3/1987 | Ward et al. | |
| 4,846,147 | A * | 7/1989 | Townsend | F23J 13/02 126/307 R |
| 5,024,596 | A | 6/1991 | Smith | |
| 5,131,238 | A | 7/1992 | Meckler | |
| 5,181,387 | A | 1/1993 | Meckler | |
| 5,609,522 | A | 3/1997 | Szwartz | |
| 5,658,140 | A | 8/1997 | Kondou et al. | |
| 6,141,495 | A | 10/2000 | Roth | |
| 6,755,138 | B2 | 6/2004 | McCarren | |
| 7,389,255 | B2 | 6/2008 | Formisano | |
| 8,079,834 | B2 | 12/2011 | Gatley, Jr. | |
| 8,844,513 | B2 | 9/2014 | LaMunyon, III | |
| 9,273,873 | B1 | 3/2016 | Ohunna, II | |
| 9,494,337 | B2 | 11/2016 | Ragg | |
| 9,618,232 | B2 | 4/2017 | Brown | |
| 9,958,184 | B2 | 5/2018 | Aycock | |
| 10,225,403 | B2 | 3/2019 | Danson et al. | |
| 10,352,585 | B1 | 7/2019 | Brown | |
| 2009/0215375 | A1 | 8/2009 | Hagensen | |
| 2016/0018130 | A1 | 1/2016 | Schmitt | |

FOREIGN PATENT DOCUMENTS

| | | | |
|---|---|---|---|
| EP | 0 203 684 | A3 | 3/1986 |
| EP | 3 527 891 | A1 | 8/2019 |
| GB | 869386 | | 5/1961 |
| GB | 2531547 | A | 4/2016 |
| RU | 2 039 912 | C1 | 7/1995 |
| WO | WO 2008/129087 | A1 | 10/2008 |
| WO | WO 2009/053527 | A1 | 4/2009 |

OTHER PUBLICATIONS

*Finned Tubular Heater*, Tempco Electric Heater Corporation, Wood Dale, IL, date unknown, accessed Apr. 26, 2022 from https://www.tempco.com/Tempco/Resources/10-Tubular-Resources/FinnedTubularCatalogPages.pdf.

*Preheating a Wood Stove Flue*, YouTube.com, Apr. 24, 2014, accessed Apr. 26, 2022 from https://www.youtube.com/watch?v=z8luQC-QLcw.

* cited by examiner

CHIMNEY FLUE HEATER

CROSS-REFERENCES TO RELATED APPLICATIONS

This application claims priority to U.S. Provisional Patent Application No. 63/183,525 filed May 3, 2021 and entitled CHIMNEY FLUE HEATER, the entire contents of which is incorporated herein for all purposes by this reference.

BACKGROUND OF INVENTION

Field of Invention

This application relates, in general, to chimney flue heaters and methods for their use.

Description of Related Art

Many homes and other buildings have wood-burning fireplaces to provide for a traditional, rustic, or relaxing ambiance. Such fireplaces generally have chimneys that extend well above the building roofline to promote an updraft within the chimney and reliably vent smoke outside.

Fireplaces are generally used in colder weather when outside air temperatures are considerably colder than interior temperatures. Colder outside air is generally denser than warmer inside air. As such, colder outside air may travel down the chimney and impede the draft necessary to vent smoke up and out the chimney. In fact, when the outside/inside air temperature differential is enough, colder and denser outside air can create an undesirable downdraft and carry dangerous smoke and fumes out from the fireplace and into the building.

Traditionally, one would light newspaper or small kindling to create a flame to preheat the air temperature within the chimney and jump-start an updraft to prevent smoke and fumes from spilling out from the fireplace and into the building. However, such preheating may be of limited effect, especially when the outside/inside air temperature differential is significant.

Various devices are known to preheat chimneys and jump-start updrafts, however such devices may be inconvenient, time-consuming, and/or costly. An exemplar of the prior art is U.S. Pat. No. 6,141,495 which describes a portable flue heater designed for attachment to (or adjacent) a chimney flue damper before igniting a fire and removal immediately prior to lighting a fire. The '495 patent also describes prior devices that are permanently built into chimneys, which devices have the inherent disadvantage of needing to be installed when the chimney is built.

There is an unmet need in the field for less expensive and less cumbersome means of inducing an updraft within a chimney. The present disclosure meets these and other needs by providing a chimney flue heater that can be readily installed on new or existing chimneys and that can be left in place once installed.

BRIEF SUMMARY

One aspect of the present invention is directed to a chimney flue heater detachably mounted to a flue liner of a chimney for selectively inducing an updraft within a chimney flue, the chimney flue heater including: a body configured to releasably engage and hang from a top edge of the flue liner, the body including a planar support and a hanger assembly; wherein the hanger assembly includes (i) a top member extending outwardly from an upper portion of the planar support and (ii) a side member extending downwardly from the top member, whereby the hanger assembly is configured to receive and rest upon the top edge of the flue liner with the side member extending downwardly and overlapping an outer surface of the flue liner; wherein the planar support extends downwardly from the hanger assembly and is configured to extend along an inner surface of the flue liner within a top portion of the chimney flue; and a heating assembly mounted on the planar support opposite the hanger assembly, the heating assembly including an electric heating element configured to heat air within the chimney flue to induce an updraft within the chimney flue.

Another aspect of the present invention is directed to a method of installing the above chimney flue heater, the method including: inserting one of the above chimney flue heaters into the flue liner; hanging the hanger assembly upon the top edge of the flue liner such that (i) the top member extends outwardly across the top edge of the flue liner and (ii) the side member overlaps the outer surface of the flue liner; and operatively connecting the heating assembly to a switch remotely located in a room including a fire box of the chimney.

Embodiments of the invention may include one or more of the following features.

The hanger assembly and the planar support may be monolithically formed.

The upper portion of the planar support and the hanger assembly may form an inverted U-shaped channel configured to receive and rest upon the top edge of the flue liner.

The hanger assembly may be configured to receive and rest upon the top edge of one planar wall of the flue liner.

The hanger assembly may include a clamp member mounted on the side member to abut against an outer surface of the flue liner to detachably secure the body to the flue liner.

The clamp member may be a threaded fastener that is adjustably biased against the outer surface of the flue liner when tightened.

The planar support may be a metal plate extending substantially parallel to the inner surface of the flue liner, wherein the planar support serves as a heat shield protecting the flue liner from the heat of the electric heating element.

A spacer may hold the planar support a predetermined distance away from the flue liner.

The spacer may include a plurality of threaded fasteners extending through the planar support to hold the planar support a predetermined distance away from the flue liner.

The planar support may be a V-shaped member extending substantially parallel to the inner surface of the flue liner, wherein the planar support serves as a heat shield protecting the flue liner from the heat of the electric heating element.

The heating assembly may extend above the hanger assembly, wherein the heating assembly may include a pair of terminal connectors for operatively connecting the electric heating element to a remote power source, and wherein the terminal connectors may be located above the hanger assembly.

The heating assembly may include a controller for activating the electric heating element.

The controller may include a switch configured to be mounted in a room including a fire box of the chimney to provide a user internal control of the heating assembly.

The controller may include a timer operatively connected to the heating assembly to turn the heating assembly off after a predetermined period of time.

The controller may include a temperature sensor supported by the body and operatively connected to the heating assembly, wherein the controller turns the heating assembly off when a temperature within the chimney flue, as sensed by the temperature sensor, is above a predetermined temperature.

The heating assembly may include an electric cable for operatively connecting the electric heating element to a remote power source, wherein the hanger assembly may include two spaced-apart top members and two side members, each extending downward from a respective one of the two top members, wherein a space between the two top members and between the two side members provides an opening through which the cable extends.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents, and other embodiments, which may be included within the spirit and scope of the invention(s) as defined by the appended claims.

In accordance with various aspects of the present invention, a chimney flue heater is provided that may be readily installed on newly constructed chimneys or retrofit to existing chimneys, and which heater may be used to preheat chimneys prior to lighting a fire in order to induce an updraft through the chimney that will reliably exhaust smoke and fumes up the chimney and out of a building.

Figure 1:
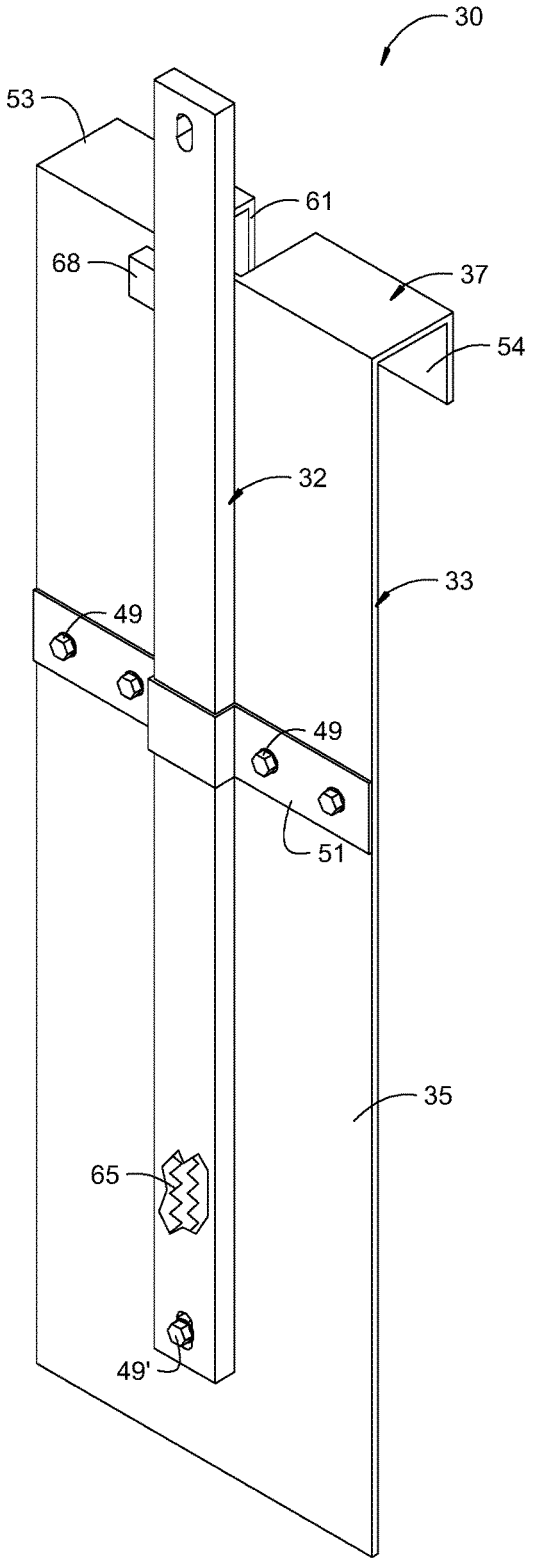
FIG. 1 is a front perspective view of an exemplary chimney flue heater in accordance with various aspects of the present invention.

Turning now to the drawings, wherein like components are designated by like reference numerals throughout the various figures, an exemplary chimney flue heater 30 is shown in FIG. 1. The heater generally includes a heating assembly 32 and a body 33 having (i) a planar support 35 and (ii) a hanger assembly 37. The planar support and the hanger assembly are configured to position the body (and the heater assembly mounted thereon) in an unobtrusive manner against an inner surface of the chimney near the top of the chimney.

Figure 4:
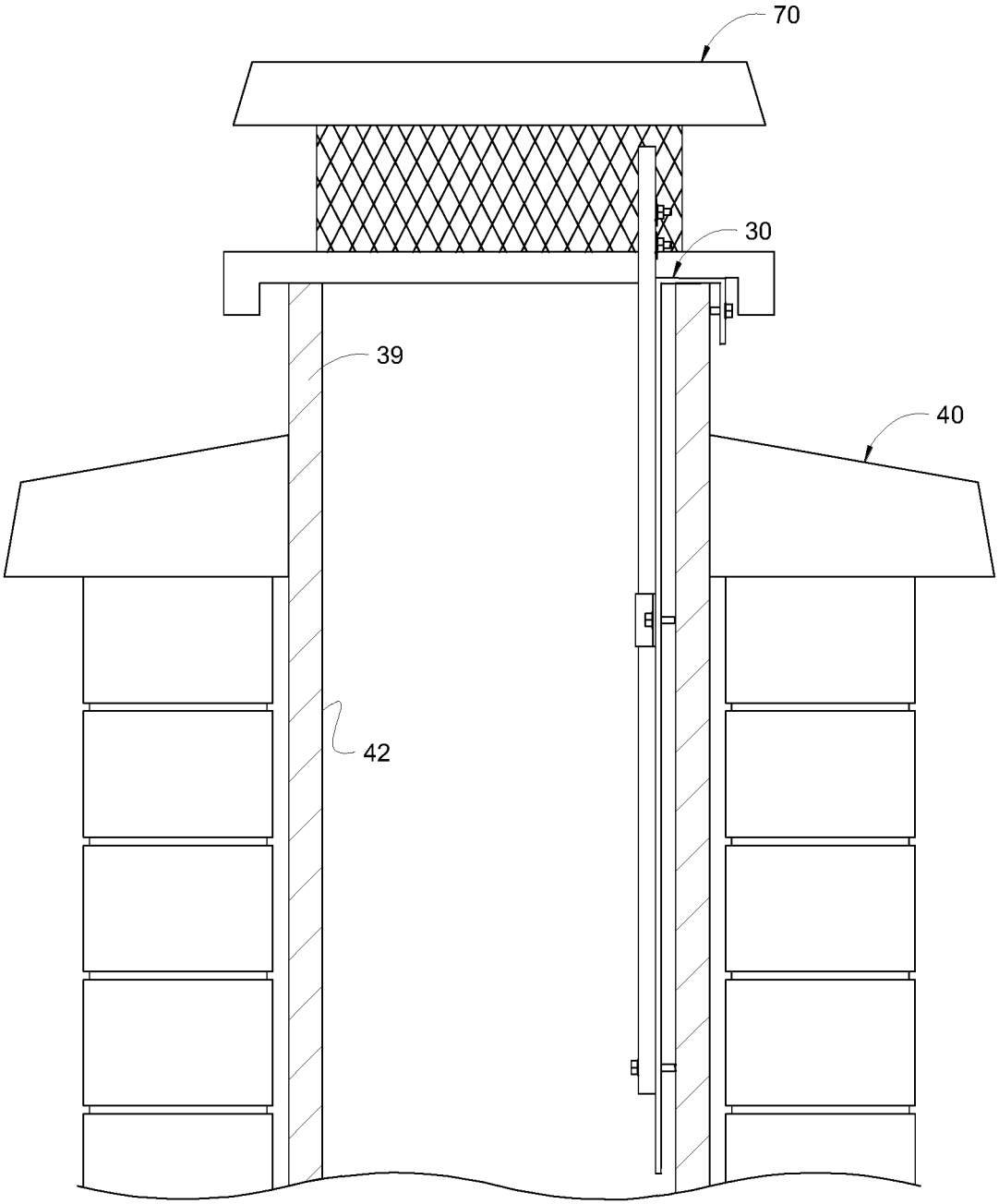
FIG. 4 is side view of the chimney flue heater of FIG. 1 mounted at the top of a chimney beneath a chimney cap, with the flue liner shown in cross-section.
Figure 5:
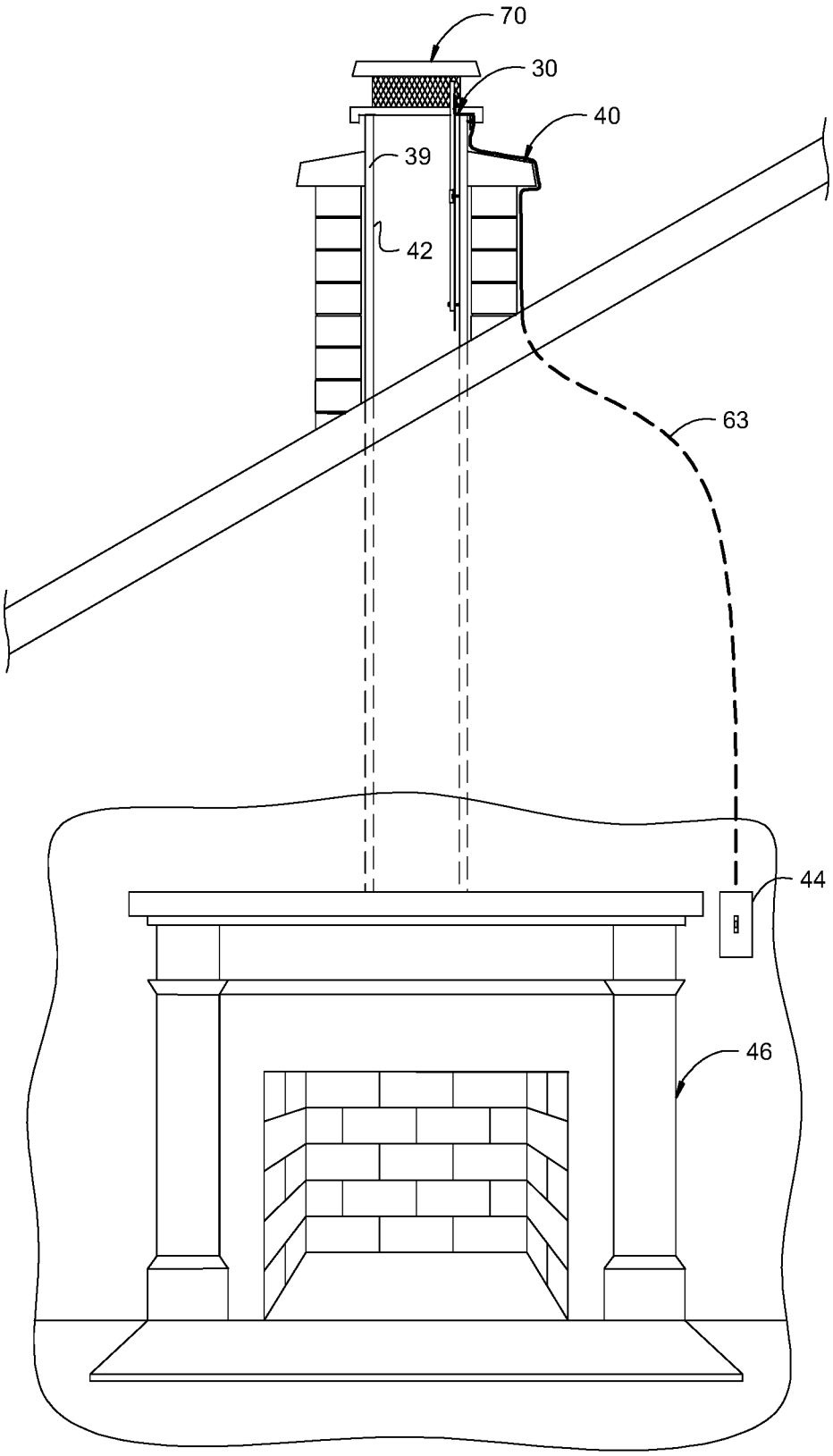
FIG. 5 is a schematic view of the chimney flue heater of FIG. 1 mounted at the top of a chimney and operatively connected to a controller by a fireplace in accordance with various aspects of the present invention.

As shown in FIG. 4 and FIG. 5, chimney flue heater 30 is configured to be detachably mounted to a flue liner 39 of a chimney 40 for selectively inducing an updraft within a chimney flue 42. The configuration of the chimney flue heater not only allows installation upon newly constructed chimneys but also allows ready retrofitting and installation upon existing chimneys. And once installed, a user need not attach anything to or within the chimney to effect preheating—a user may simply flick a switch 44 (FIG. 5) positioned in a room close to a fireplace 46 to turn on chimney flue heater 30 and conveniently warm the upper portion of chimney flue 42 (and the air therein) thereby inducing an updraft within the chimney flue.

Figure 2:
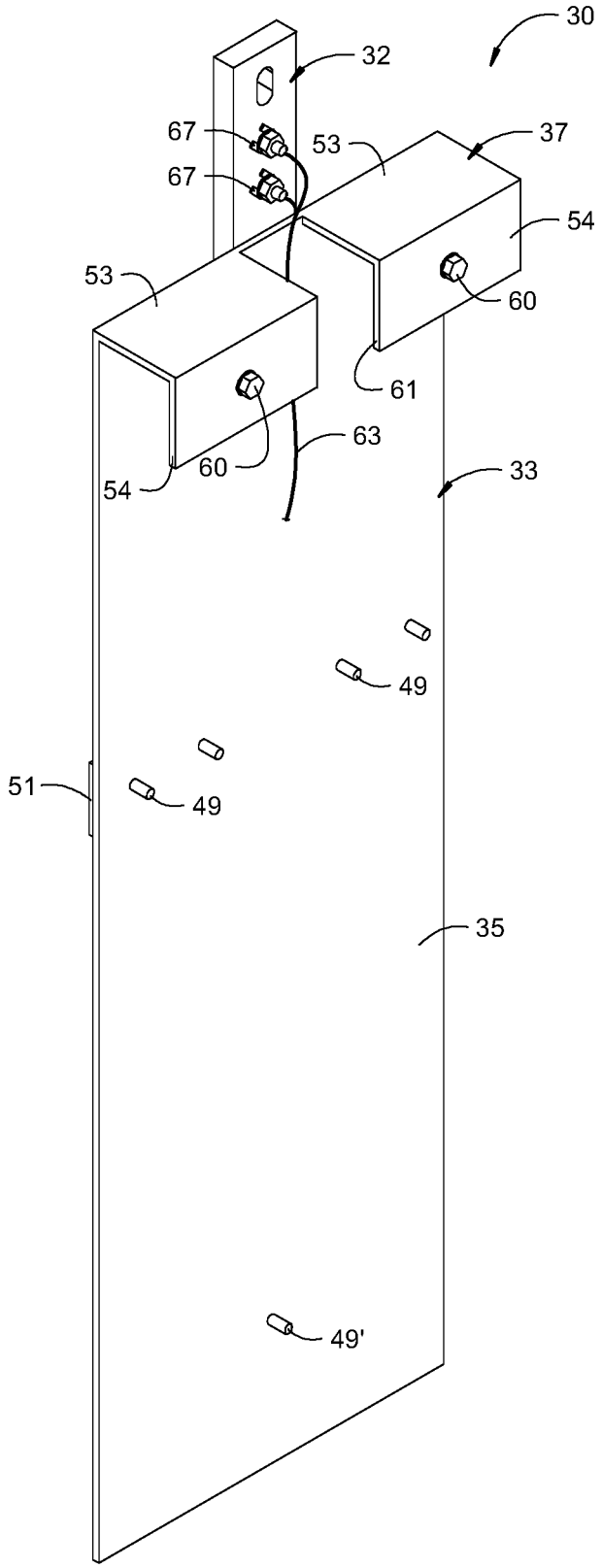
FIG. 2 is a rear perspective view of the chimney flue heater of FIG. 1.
Figure 3:
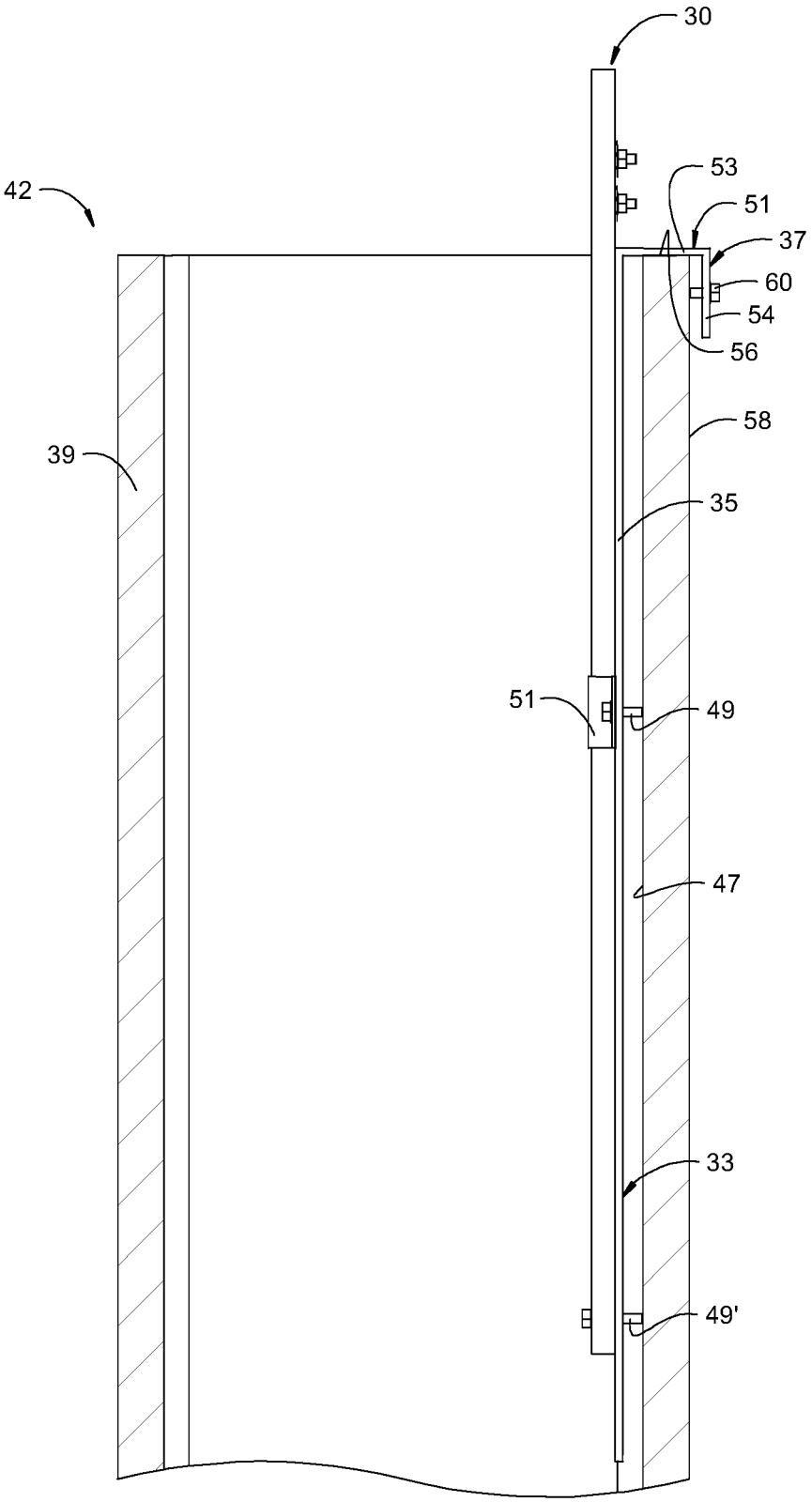
FIG. 3 is a side view of the chimney flue heater of FIG. 1 mounted within a chimney flue at the top of chimney, with a flue liner shown in cross-section.

Body 33 is configured to releasably engage and hang from a top edge 56 of flue liner 39, as seen in FIG. 3. In various embodiments, the body may be formed of sheet metal bent to shape using a sheet metal brake. In other embodiments, the body may be formed of plate metal similarly bent to shape using a metal brake, assembled with discrete members welded together in a desired shape, or extruded in a particular cross-sectional shape. In the illustrated embodiment shown in FIG. 1 and FIG. 2, the body is formed of plate aluminum that is about 0.125" to 0.25" thick and bent to shape. As such, the planar support and hanger assembly may be monolithically formed, which may simplify manufacturability and drastically reduce manufacturing costs.

One will appreciate that the body may be formed of other heat-resistant and corrosion-resistant metals and alloys including, but not limited to, steel, stainless steel, nickel, molybdenum, copper, and/or combinations thereof. One will also appreciate that other materials may be used including, but not limited to, engineered plastics such as polyimide (PI), polyether ether ketone (PEEK), ceramics, composites, and/or other suitable heat-resistant and corrosion-resistant materials.

As shown in FIG. 1 and FIG. 2, body 33 includes a planar support 35 that extends downwardly from hanger assembly 37. With reference to FIG. 3, the body is configured to extend along an inner surface 47 of flue liner 39 within a top portion of the chimney flue 42. Planar support 35 extends substantially parallel to inner surface 47 of the flue liner. One will appreciate, however, that the planar support need not be absolutely flat, uniform or continuous—the planar support need only provide an overall support structure that substantially extends relatively parallel and relatively close to the inner surface, such that planar support 35 together with heating assembly 32 are closely positioned against the inner surface of the flue liner in an unobtrusive manner that does not block or obscure smoke, fumes and gases rising up through the chimney from a burning fire below.

Planar support 35 not only provides a mount for holding heating assembly 32 to one side of the chimney flue, the planar support may also serve as a heat shield protecting the flue liner from the heat of the heating assembly. Depending upon the configuration of the planar support, it may rest directly against the inner surface of the flue liner, or it may be spaced from the inner surface. For example, one or more spacers 49 may be provided to hold the planar support a predetermined distance away from the inner surface of the flue liner, as shown in FIG. 3. Depending upon the configuration of the planar support, the configuration of the heating assembly, and other variables, the spacers may hold the planar support about ¼ inch to ½ inch (or more) away from the inner surface.

In the simplest form, the spacers may be threaded fasteners extending through the planar support. Such threaded fasteners may also be used to secure other components to the planar support. As shown in FIG. 1 and FIG. 2, threaded fasteners 49 secure a bracket 51 to planar support 35 that partially secures heating assembly 32 to the planar support, and threaded fastener 49' partially secures the heating assembly directly to the planar support.

Hanger assembly 37 generally includes (i) a top member 53 extending outwardly from an upper portion of planar support 35 and (ii) a side member 54 extending downwardly from the top member. The configuration of the top and side members allows the hanger assembly to receive and rest upon a top edge 56 of the flue liner, as shown in FIG. 3. In various embodiments, the upper portion of planar support 35, the top member 53 and the side member 54 form an inverted U-shaped channel that receives and rests upon the top edge of the flue liner.

As also shown in FIG. 3, side member 54 extends downwardly and overlaps an outer surface 58 of the flue liner by a predetermined distance. In various embodiments, the side member overlaps the flue liner about one inch or more in order to provide sufficient engagement of the hanger assembly with the flue liner to simplify installation and provide an appropriate clamping area for long-term mounting of hanger assembly 37 to the flue liner.

A clamp member 60 may be mounted on side member 54 to abut against outer surface 58 of flue liner 39 and detachably secure body 33 to the flue liner. The clamp member may be a threaded fastener that is adjustably biased against the outer surface of the flue liner when tightened. One will appreciate that such a clamp member may also be provided on the upper portion of the planar support and adjustably biased against the inner surface of flue liner to detachably secure the body to the flue liner. One will also appreciate that other suitable clamping means may be utilized to detachably secure the body to the flue liner in an otherwise conventional manner.

In the illustrated embodiment, the hanger assembly is configured to receive and rest upon the top edge of one planar wall of the flue liner such that the planar support extends parallel to the one planar wall. One will appreciate that the chimney flue heater may be configured to extend parallel to one, two, or more walls of the flue liner, provided that the heater does not block or obscure smoke, fumes and gases rising up through the chimney.

As shown in FIG. 2, hanger assembly 37 may include two spaced-apart top members 53 and two side members 54, each side member extending downward from a respective one of the two top members. Such configuration advantageously may provide a space or opening 61 providing clearance within the hanger assembly allowing an electric cable 63 to extend from heating assembly 32 and pass through the hanger assembly.

Heating assembly 32 is mounted on planar support 35 opposite hanger assembly 37 and away from the inner surface of the flue liner when positioned within the flue liner. The heater assembly generally includes an electric heating element 65 (schematically shown in FIG. 1) configured to heat air within the chimney flue and induce an updraft within the chimney flue. For example, the heating assembly may be a channel strip heater of the type provided by Tempco Electric Heater Corporation (Wood Dale IL), which strip heaters provide a reliable heat source with a low thickness dimension thus contributing to the unobtrusive profile of the present chimney flue heater. One will appreciate that other suitable heating assemblies may be utilized in accordance with various aspects of the present invention provided they can be readily mounted on the body and remotely controlled by a switch.

With reference to FIG. 2, heating assembly 32 may extend above hanger assembly 37 and include a pair of terminal connectors 67 for operatively connecting the electric heating element to a remote power source via electric cable 63. In order to promote ease of installation and to locate the electric cable away from smoke, fumes and hot gases rising though the chimney, the terminal connectors are located above hanger assembly 37 and on an outside surface of the heating assembly. Such configuration also facilitates the electric cable in passing through opening 61 formed between the two spaced-apart top members 53 and the two side members 54.

The heating assembly may include a controller for activating the electric heating element. In the simplest form, the controller may be switch 44 that is mounted in the room housing fireplace 46 to provide a user readily accessible internal control of the heating assembly, as shown in FIG. 5.

The controller may include a timer operatively connected to the heating assembly to turn the heating assembly off after a predetermined period of time so that the heating assembly is not inadvertently left on for an extended period of time. The timer may also be in the form of a countdown timer switch 44, which may be of the type used for bathroom fans and household lights in otherwise conventional manners.

In various embodiments, the controller may include a temperature sensor 68 that is supported by body 33 within chimney flue 42 and operatively connected to heating assembly 32. The controller may be configured to turn the heating assembly off when a temperature within the chimney flue, as sensed by the temperature sensor, is above a predetermined temperature. For example, it is desirable to keep the temperature within the chimney flue below the flashpoint of hydrocarbon gases rising up through the chimney and/or the flashpoint of creosote that may buildup within the chimney. Accordingly, it is desirable to turn the heater assembly off well before the temperature within an upper portion of the chimney reaches about 450° F., and more preferably when the temperature exceeds about 150° F. to 200° F., which temperature range is generally sufficient to induce an updraft and well below flashpoint dangers. Alternatively, the temperature sensor may provide feedback to the controller allowing heating assembly to slowly warm so as to minimize thermal damage to the flue liner, and/or adjust the thermal power of the heating assembly as needed to maintain a desired temperature within the chimney flue.

With reference to FIG. 4, chimney flue heater 30 may be mounted on a newly-constructed or existing chimney 40 such that hanger assembly 37 rests upon and overlaps a top edge of flue liner 39. The low-profile configuration of the hanger assembly allows the chimney flue heater to conveniently rest within and below a chimney cap 70 without impeding installation of the chimney cap upon flue liner 39 in an otherwise conventional manner. Electric cable 63 may extend from terminal connectors 67 of heating assembly 32 through the opening between the top and side members and between the top edge of flue liner and a bottom surface of the chimney cap, such that the electric cable may continue down along a wall of the house to switch 44, as shown in FIG. 5.

With the switch located proximal fireplace 46, a user may readily turn on chimney flue heater prior to lighting a fire within the fireplace and preheat the chimney flue to induce an updraft within the chimney. The user may turn off the chimney flue heater immediately before or after starting a fire in the fireplace, or at such time the user is confident an updraft will direct smoke, fumes, and gases up the chimney, away from the room, and out of the building. As noted above, a timer may automatically turn off the chimney flue heater after a predetermined time, thus requiring no further action from the user after the heater is initially turned on.

While the chimney flue heater described herein is described as being used with a chimney of a fireplace, one will appreciate that it may also be used with chimneys for various fireboxes and combustion chambers, including, but not limited to, wood stoves and the like.

Figure 7:
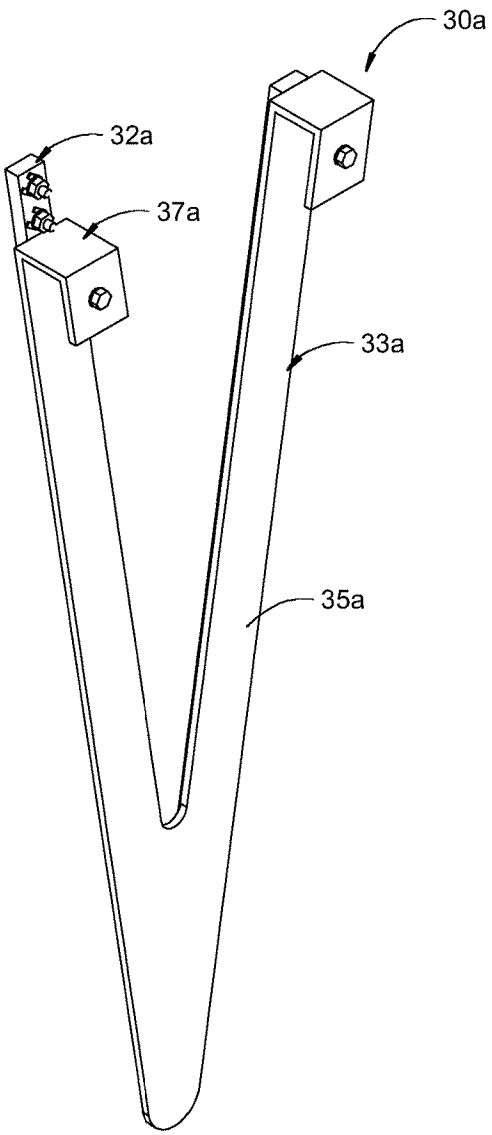
FIG. 7 is a rear perspective view of the chimney flue heater of FIG. 6.
Figure 6:
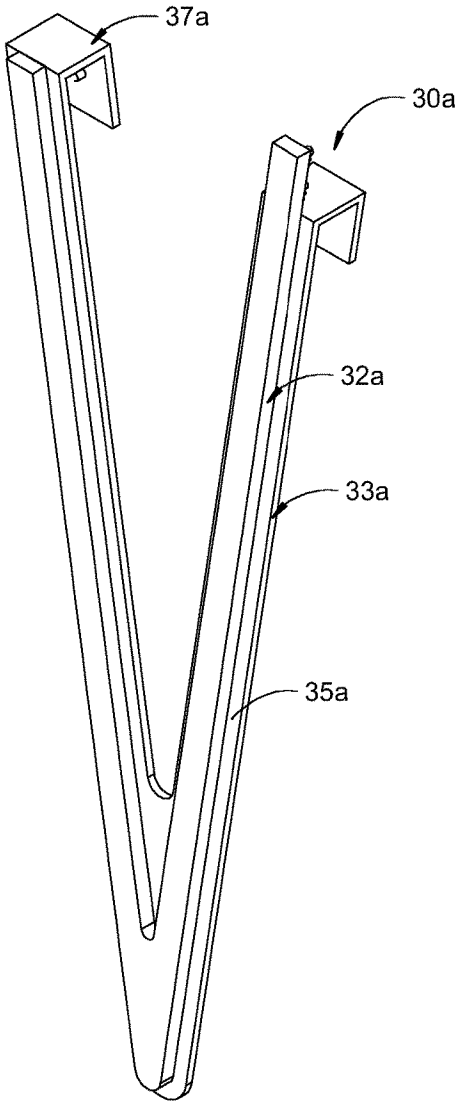
FIG. 6 is a front perspective view of another exemplary chimney flue heater in accordance with various aspects of the present invention.

In another exemplary embodiment shown in FIG. 6 and FIG. 7, chimney flue heater 30*a* is similar to that described above but includes a V-shaped body 33*a*. Like reference numerals have been used to describe like components of heater 30*a* and heater 30 described above.

Chimney flue heater 30*a* includes a planar support 35*a* in the form of a V-shaped member that is configured to extend substantially parallel to the inner surface of a flue liner in the same manner as planar support 35 described above. One will appreciate that the planar support may have other shapes and configurations. For example, the planar support may be U-shaped, W-shaped, M-shaped, and so on, providing a surface area to mount a heating assembly thereto, and serving as a heat shield protecting the flue liner from the heat of the heating assembly.

In operation and use, chimney flue heater 30*a* is used in substantially the same manner as chimney flue heater 30 discussed above.

For convenience in explanation and accurate definition in the appended claims, the terms "up" or "upper", "down" or "lower", "inside" and "outside" are used to describe features of the exemplary embodiments with reference to the positions of such features as displayed in the figures.

In many respects, various modified features of the various figures resemble those of preceding features and the same reference numerals followed by the subscript "a" designate corresponding parts.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A chimney flue heater detachably mounted to a flue liner of a chimney for selectively inducing an updraft within a chimney flue, the chimney flue heater comprising:

a body configured to releasably engage and hang from a top edge of the flue liner, the body including a planar support and a hanger assembly;

wherein the hanger assembly includes (i) a top member extending outwardly from an upper portion of the planar support and (ii) a side member extending downwardly from the top member, whereby the hanger assembly is configured to receive and rest upon the top edge of the flue liner with the side member extending downwardly and overlapping an outer surface of the flue liner;

wherein the planar support extends downwardly from the hanger assembly and is configured to extend along an inner surface of the flue liner within a top portion of the chimney flue; and a heating assembly mounted on the planar support opposite the hanger assembly, the heating assembly including an electric heating element configured to heat air within the chimney flue to induce an updraft within the chimney flue.

2. The chimney flue heater according to claim 1, wherein the hanger assembly and the planar support are monolithically formed.

3. The chimney flue heater according to claim 1, wherein the upper portion of the planar support and the hanger assembly form an inverted U-shaped channel configured to receive and rest upon the top edge of the flue liner.

4. The chimney flue heater according to claim 1, wherein the hanger assembly is configured to receive and rest upon the top edge of one planar wall of the flue liner.

5. The chimney flue heater according to claim 1, wherein the hanger assembly includes a clamp member mounted on the side member to abut against an outer surface of the flue liner to detachably secure the body to the flue liner.

6. The chimney flue heater according to claim 1, wherein the clamp member is a threaded fastener that is adjustably biased against the outer surface of the flue liner when tightened.

7. The chimney flue heater according to claim 1, wherein the planar support is a metal plate extending substantially parallel to the inner surface of the flue liner, wherein the planar support serves as a heat shield protecting the flue liner from the heat of the electric heating element.

8. The chimney flue heater according to claim 7, wherein a spacer holds the planar support a predetermined distance away from the flue liner.

9. The chimney flue heater according to claim 8, wherein the spacer includes a plurality of threaded fasteners extending through the planar support to hold the planar support a predetermined distance away from the flue liner.

10. The chimney flue heater according to claim 1, wherein the planar support is a V-shaped member extending substantially parallel to the inner surface of the flue liner, wherein the planar support serves as a heat shield protecting the flue liner from the heat of the electric heating element.

11. The chimney flue heater according to claim 1, wherein the heating assembly extends above the hanger assembly, wherein the heating assembly includes a pair of terminal connectors for operatively connecting the electric heating element to a remote power source, and wherein the terminal connectors are located above the hanger assembly.

12. The chimney flue heater according to claim 1, wherein the heating assembly includes a controller for activating the electric heating element.

13. The chimney flue heater according to claim 12, wherein the controller includes a switch configured to be mounted in a room including a fire box of the chimney to provide a user internal control of the heating assembly.

14. The chimney flue heater according to claim 12, wherein the controller includes a timer operatively connected to the heating assembly to turn the heating assembly off after a predetermined period of time.

15. The chimney flue heater according to claim 12, wherein the controller includes a temperature sensor supported by the body and operatively connected to the heating assembly, wherein the controller turns the heating assembly off when a temperature within the chimney flue, as sensed by the temperature sensor, is above a predetermined temperature.

16. The chimney flue heater according to claim 1, wherein the heating assembly includes an electric cable for operatively connecting the electric heating element to a remote power source, wherein the hanger assembly includes two spaced-apart top members and two side members, each extending downward from a respective one of the two top members, wherein a space between the two top members and between the two side members provides an opening through which the cable extends.

17. A method of installing a chimney flue heater comprising:

inserting the chimney flue heater of claim 1 into the flue liner;

hanging the hanger assembly upon the top edge of the flue liner such that (i) the top member extends outwardly across the top edge of the flue liner and (ii) the side member overlaps the outer surface of the flue liner; and operatively connecting the heating assembly to a switch remotely located in a room including a fire box of the chimney.

* * * * *